US005357703A

United States Patent [19]

Chesnut et al.

[11] Patent Number: 5,357,703

[45] Date of Patent: Oct. 25, 1994

[54] CARTRIDGE MAGAZINE HAVING A METAL BODY USED WITH A PLASTIC FIREARM

[75] Inventors: M. Gaines Chesnut, Golden; Marc Ulasik, Longmont; Dennis D. Sweet, Evergreen, all of Colo.

[73] Assignee: Ram-Line, Inc., Wheatridge, Colo.

[21] Appl. No.: 2,852

[22] Filed: Jan. 13, 1993

[51] Int. Cl.[5] ..... F41A 9/70

[52] U.S. Cl. ..... 42/50

[58] Field of Search ..... 42/7, 18, 22, 50

[56] References Cited

U.S. PATENT DOCUMENTS

| | | | |
|---|---|---|---|
| 708,794 | 9/1902 | Browning | 42/7 |
| 804,985 | 11/1905 | Searle | 42/50 |
| 4,539,889 | 9/1985 | Glock | 89/147 |
| 4,790,094 | 12/1988 | Chesnut et al. | 42/50 |
| 4,888,899 | 12/1989 | Chesnut et al. | 42/50 |

FOREIGN PATENT DOCUMENTS

| | | | |
|---|---|---|---|
| 2247698 | 4/1974 | Fed. Rep. of Germany | 42/50 |
| 147379 | 10/1954 | Sweden | 42/50 |
| 831218 | 3/1960 | United Kingdom | 42/50 |

*Primary Examiner*—Stephen C. Bentley

*Attorney, Agent, or Firm*—Sheridan Ross & McIntosh

[57] ABSTRACT

A magazine is disclosed for use with a pistol having a plastic firearm latch that is used to hold the magazine in the pistol well. The magazine includes an all metal magazine body. A non-metal magazine latch member is connected to the magazine body. When the magazine is held in the pistol well, the plastic firearm latch in the pistol engages the non-metal magazine latch member. In one embodiment, a carbon fiber filled firearm latch is substituted for the plastic firearm latch. A spacer assembly is held adjacent an end wall of the magazine body. The spacer assembly has a smooth outer surface for engagement by rim ends of cartridges during their movement relative to the magazine body. A non-symmetrical rib formed on the inner surface of a side wall of the magazine body is engagable by cartridges during their movement to prevent a premature bolt hold open condition. The magazine includes a follower assembly in which the crown section is located adjacent a side wall of the follower body opposite the side wall that is adjacent to the bolt hold open latch. This arrangement assists in providing the proper engagement between the bolt hold open latch and a bolt hold open mechanism in the pistol.

17 Claims, 15 Drawing Sheets

CARTRIDGE MAGAZINE HAVING A METAL BODY USED WITH A PLASTIC FIREARM

FIELD OF THE INVENTION

The present invention relates to magazines for use with firearms and, in particular, to a metallic body magazine having a nonmetallic latch and/or spacer insert.

BACKGROUND OF THE INVENTION

Pistols have been devised that are made of plastic or other nonmetallic materials. The plastic parts of such pistols typically include the grip that has a well for receiving a magazine containing cartridges. In U.S. Pat. No. 4,539,889 to Glock issued Sep. 10, 1985 and entitled "Automatic Pistol with Counteracting Spring Control Mechanism," a pistol is disclosed of the type that can include a grip made of a nonmetallic or plastic material. With regard to magazines used with a Glock pistol having the plastic hand grip, the owner of this patent makes a magazine that includes a molded plastic housing with separate metal inserts. A firearm latch is connected to the plastic grip and is used in engaging a magazine latch provided with this Glock magazine. This firearm latch is plastic and is made from a soft, pliable elastomer. The magazine latch is formed as part of the molded plastic housing. Consequently, the plastic firearm latch engages plastic portions of the magazine. In addition to this plastic magazine with metal inserts, an all metal magazine is available for use with a Glock pistol having a plastic grip. This all metal magazine also incorporates an integral metal magazine latch. When this metal magazine is held using the plastic firearm latch of the Glock pistol, premature or unwanted wear of the plastic firearm latch occurs due to the interaction between the metal and plastic parts. Because metal magazines have certain characteristics, such as strength, that are found to be desirable by shooters or users of magazines used in Glock pistols, it would be beneficial to incorporate metal magazine body features into a magazine without causing undesired wear to the nonmetallic firearm latch held in the grip of the Glock pistol.

In addition to the latch mechanisms on the magazine and the plastic grip of the Glock pistol, other problems are encountered in providing a satisfactory functional magazine for use with such a pistol. The magazine must be configured to properly fit the well. The chamber defined within the walls of the magazine for containing cartridges and a follower assembly must be appropriately sized to house and facilitate movement of the cartridges. As with other magazines, timely and proper control of the "bolt hold open mechanism" of the pistol must occur. The bolt hold open mechanism is activated when there are no more cartridges in the magazine and provides an indication to the shooter that the magazine chamber is empty. Problems related to improperly controlled cartridge movements resulting in unwanted activation of this mechanism must be solved. Similarly, in conjunction with the release of the last cartridge from the magazine, the problem that results in a failure of the bolt hold open mechanism to be activated must also be addressed and solved. Inadvertent jamming of the follower on internal rib structures in all-metal magazines must also be avoided.

SUMMARY OF THE INVENTION

In accordance with the present invention, a magazine is disclosed for use with a firearm and includes a substantially all metal body and a nonmetallic, such as plastic, latch member. The magazine is usable with a Glock pistol. Preferably also, a non-metal spacer assembly is provided within the magazine body. The metal body is made from spring steel with suitable chemical properties to allow heat treatment so that the body returns to its original structured state after deflection. This magazine is usable with a firearm that has a plastic grip and a plastic firearm latch held in the grip. In one embodiment, the nonmetallic latch member is connected to a metal latch retainer provided on the metal magazine body. This latch retainer includes two spaced tabs or wing members and a center tab disposed therebetween. A series of slots are formed about the periphery of the center tab and adjacent to the wing members. Additional slots are formed inwardly of the magazine body and at one end of the wing members. In one embodiment, the nonmetallic latch member is inserted between these two wing members. This latch member includes two side walls for use in contacting these wing member edges. Basically, the latch member is tightly held between the wing members and the bottom sides of the latch member snap into or engage the slotted areas. When the magazine body of the present invention is inserted into a well of a pistol having a plastic firearm latch, instead of engaging magazine metal, engagement is provided between the plastic firearm latch and the inserted, or fixedly held in place, nonmetallic latch member.

The spacer assembly of the present invention specifically eliminates the need for certain ribs found in current all-metal magazine bodies. In the case in which the chamber or area within the walls of the magazine body is too large, the spacer assembly acts to occupy some of the space, instead of using ribs. In one embodiment, the spacer assembly includes a spacer body that is disposed to overlie an inner surface of a first end wall of the magazine body. To connect the spacer body to the first end wall, a number of tabs extend from the body for receipt by holes formed in the magazine body adjacent to the first end wall. The spacer assembly satisfactorily accommodates proper movement of the cartridges within the magazine body chamber. In a preferred embodiment, the outer surface of the spacer body is made of a substantially smooth material. Rim ends of the cartridges in the magazine chamber engage this smooth surface during their movement. Such a smooth surface has very low friction and thereby facilitates cartridge movement.

In a preferred embodiment, the magazine of the present invention includes a chamber storage zone and a chamber transition zone. In the storage zone, the cartridges are arranged in the magazine in a double column configuration. In the transition zone, the double column arrangement is transitioned to a single column so that a single cartridge exits or is released from an outlet end of the magazine body into the firearm. In causing the transition from the storage area having the double column of cartridges to the single column, first and second ribs are formed on the inner surfaces of the side walls of the magazine body. In one embodiment, the second rib is not symmetrical to the first rib. That is, upper end portions of the second rib adjacent to the outlet end of the magazine inwardly taper towards a second end wall of the magazine. This inward tapering portion preferably includes a flattened area. These structural aspects of the second rib provide a desired contact or engagement with each cartridge as it moves to this position in the magazine chamber to prevent premature opening of the bolt hold mechanism that can occur with long or unusual cartridge head designs.

The follower assembly contained in the magazine chamber is constructed in accordance with certain criteria to ensure or enhance the activation of the bolt hold open mechanism indicating that the magazine is empty of cartridges. Specifically, the follower assembly includes a follower body having a first side wall and a second side wall. A bolt hold open platform is formed adjacent to the first side wall of the follower body for engagement with a bolt hold open mechanism on the pistol. The follower body also has a crown section that constitutes the highest area of the follower body. In conjunction with this crown section, the magazine body includes first and second lips located at the outlet end. The first lip is an integral part of the first side wall and is located adjacent the bolt hold open platform when it is used to activate the bolt hold open mechanism. The second lip is an integral part of the second side wall. In connection with the exiting of the last cartridge from the magazine outlet end, the crown section engages the second lip, which causes movement of the follower body in a way that better positions the bolt hold open platform for engagement with the bolt hold open mechanism on the pistol.

With regard to another embodiment that involves the firearm latch, the plastic firearm latch that is used with the Glock pistol is replaced with a non-plastic firearm latch. Preferably, this firearm latch includes carbon fiber material that is substantially harder than plastic. As a result, wear due to engagement with the latch on the magazine is substantially reduced and the life expectancy of the firearm latch is substantially augmented. The geometry of this new firearm latch is also such so as to provide a greater engagement area or "footprint" between the firearm latch and the magazine latch. Essentially, contact between the firearm latch and the magazine latch is achieved using substantially all available portions of the magazine latch at least up to where the magazine body begins to round or curve at its end wall.

Based on the foregoing summary, a number of salient features of the present invention are readily discerned. An all metal magazine body, together with a nonmetallic magazine latch, are usable with a firearm having a plastic firearm latch. In particular, the magazine is configured to be used with a Glock pistol having a plastic grip and in which the magazine is removable from the Glock pistol by engaging a firearm latch and without the need by a user or shooter to pull on the magazine to remove it from the firearm well after release of the firearm latch. Because two non-metal parts are in contact to hold the magazine in the firearm, wear of the plastic firearm latch is substantially prevented or reduced. The nonmetallic magazine latch is easily joined to the magazine body and is fixedly held. Consequently, the benefits of an all metal or all steel magazine body are achieved without sacrificing part durability. The magazine body is made of spring steel and is heat treatable for better maintaining its original shape. A spacer assembly is also provided that, not only achieves a desired magazine chamber size, but also assists in providing reduced friction when cartridges are being moved in the magazine chamber. In the transition zone of the magazine, a non-symmetrical rib portion is provided for making sure that no cartridge improperly causes the bolt hold open mechanism to activate or open before release of the last cartridge. A follower assembly is also provided that is characterized by locating a crown section thereof so that it engages a lip of the magazine to better position a bolt hold open platform on the follower body for engagement by the bolt hold open mechanism of the firearm. Lastly, as another solution to reducing firearm latch wear, a carbon fiber filled firearm latch is substitutable for the conventional or prior art firearm latch found in the Glock plastic pistol. This firearm latch provides more engagement area between it and the magazine latch thereby achieving a stronger connection between the firearm and the magazine.

Additional advantages of the present invention will become readily apparent from the following discussion, particularly when taken together with the accompanying drawing figures.

DETAILED DESCRIPTION

Figure 1:
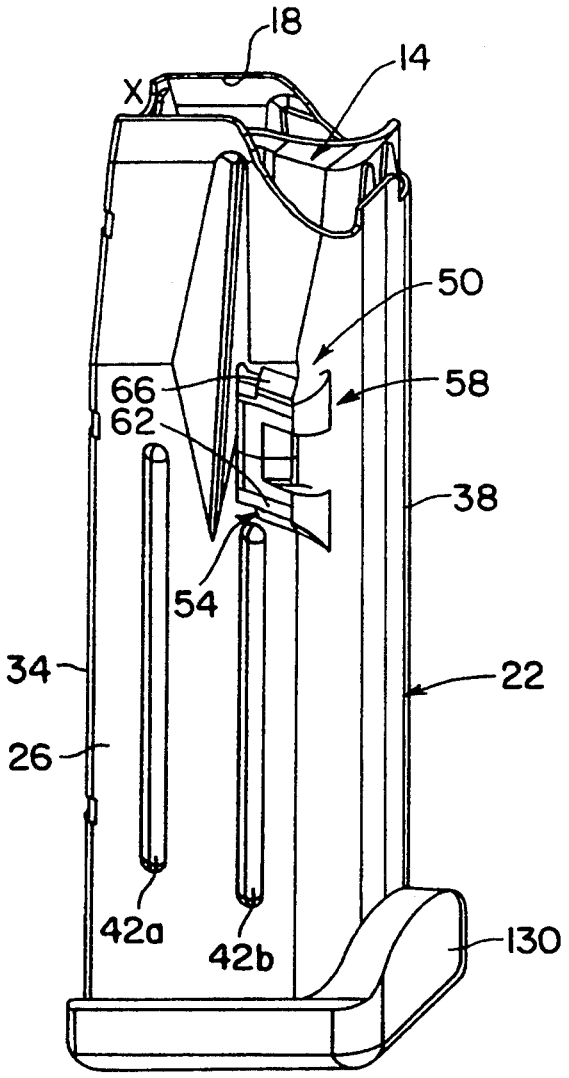
FIG. 1 is a perspective front view of the magazine of the present invention.
Figure 2:
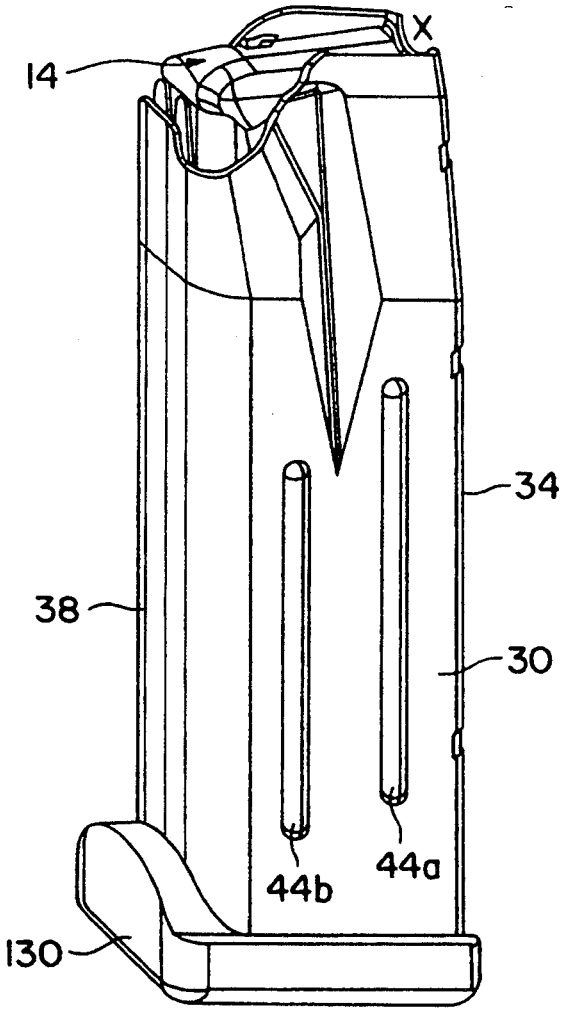
FIG. 2 is a perspective rear view of the magazine of the present invention.

With reference to FIGS. 1 and 2, a magazine 10 is illustrated for containing cartridges. The magazine 10 is received and held in a well of a firearm. Cartridges are individually urged upwardly into the firearm using a follower assembly 14 that is contained within a magazine chamber 18, which is the interior area of a magazine body 22. The magazine body 22 is made of metal, and includes four integrally formed walls. The metal is preferably heat treatable spring steel that returns to its original dimensions after deflection so that the cartridges are properly held and moved within the chamber 18. A first side wall 26 is shown in FIG. 1 and a second side wall 30 is shown in FIG. 2. A first end wall 34 interconnects the first and second side walls 26, 30 at one side (left side of FIG. 1) and a second end wall 38 interconnects the two side walls 26, 30 at the opposite side (right side of FIG. 1). In one embodiment, each of the two side walls includes exterior spacer ribs, with first and second exterior ribs **42*a*, 42*b* being formed on the first side wall 26 and third and fourth exterior ribs 44*a*, 44*b* being formed on the second side wall 30. The ribs 42*a*, 42*b*, 44*a*, 44*b* contribute to a desired fit or engagement between the magazine 10** and the firearm well and, particularly, the firearm well of a Glock pistol having a plastic grip that defines the well.

To hold the magazine 10 in the firearm well, the magazine 10 includes a latch assembly 50 provided on the first side wall 26. The latch assembly 50 engages or cooperates with a firearm latch located in the firearm magazine well. The firearm latch is, in one embodiment, such as the original Glock pistol, a plastic piece connected to the plastic grip of the Glock pistol. Such a firearm latch is used to mate with the latch assembly 50 after the magazine 10 is properly located in the firearm well. To remove the magazine 10 from the firearm well, by engaging or pushing on the firearm latch, it is translated away from engagement and the user or shooter of the firearm allows the magazine 10 to be released from the firearm well.

Figure 3:
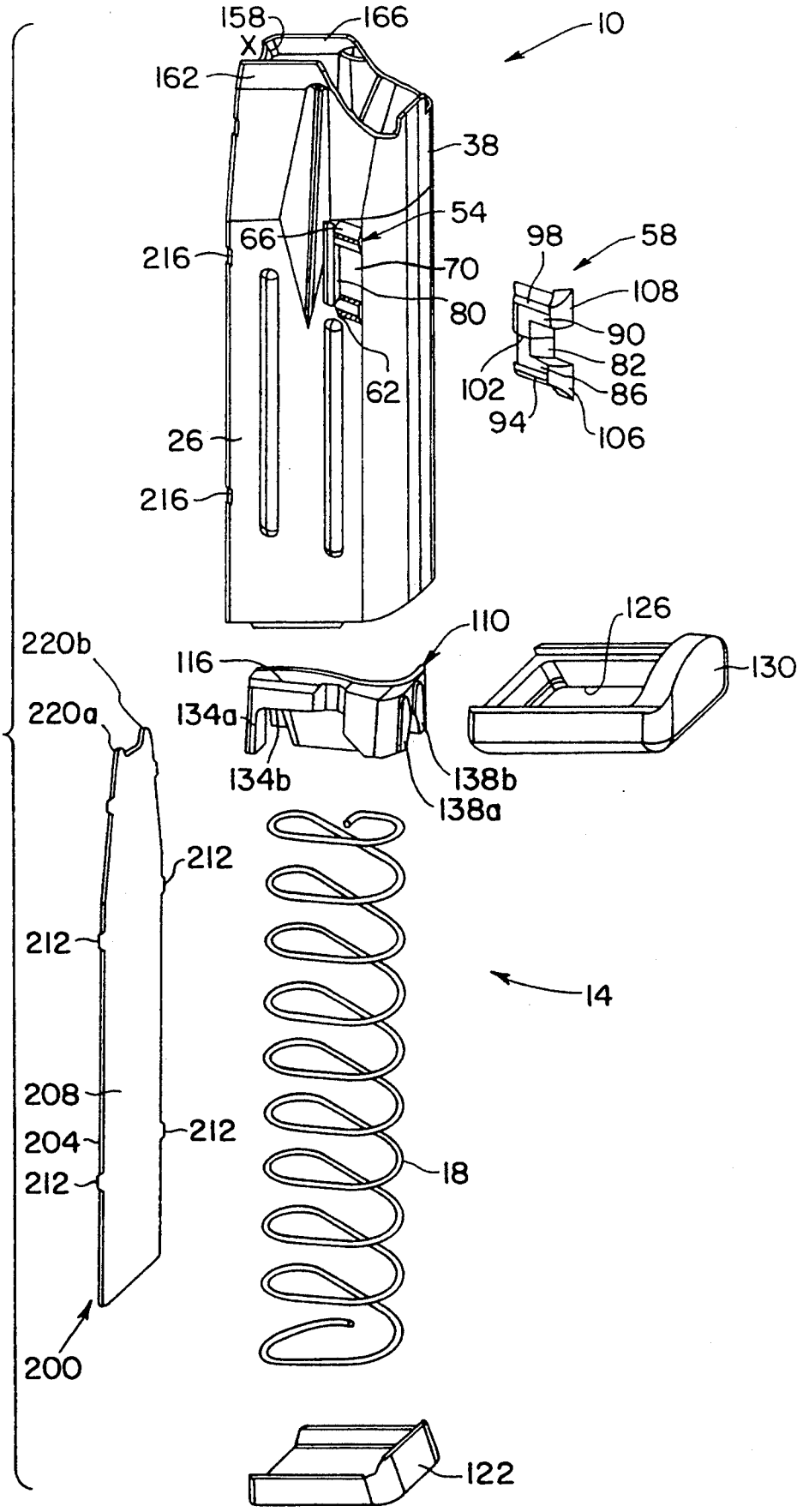
FIG. 3 is an exploded view illustrating the separate parts of the magazine.
Figure 4A:
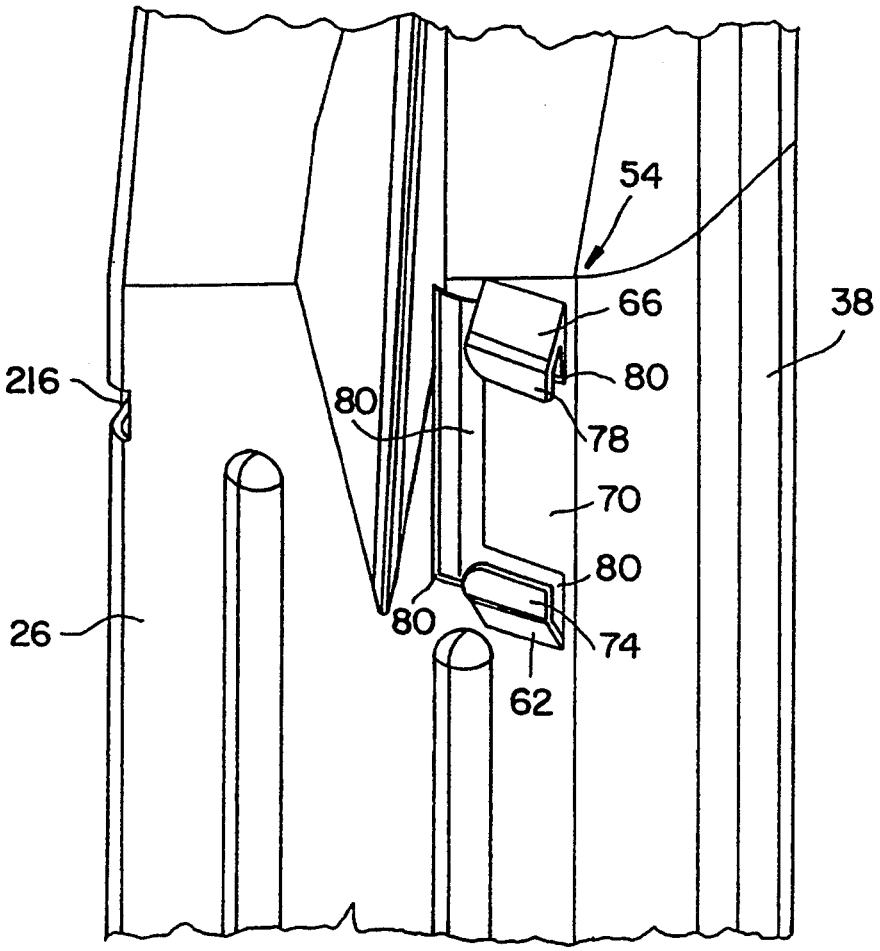
FIG. 4A, 4B is an enlarged, perspective front view of the nonmetallic member for insertion and connection to the magazine latch assembly.
Figure 4B:
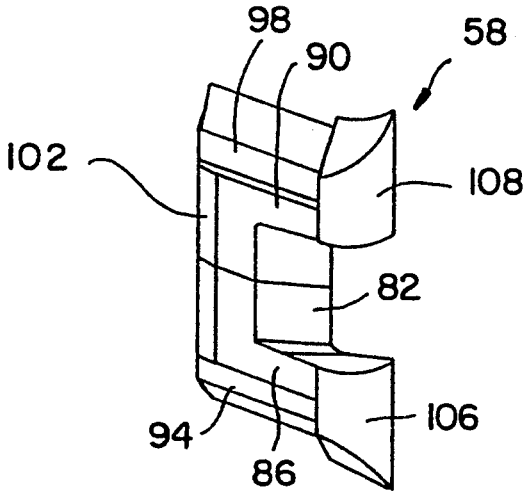
Figure 5A:
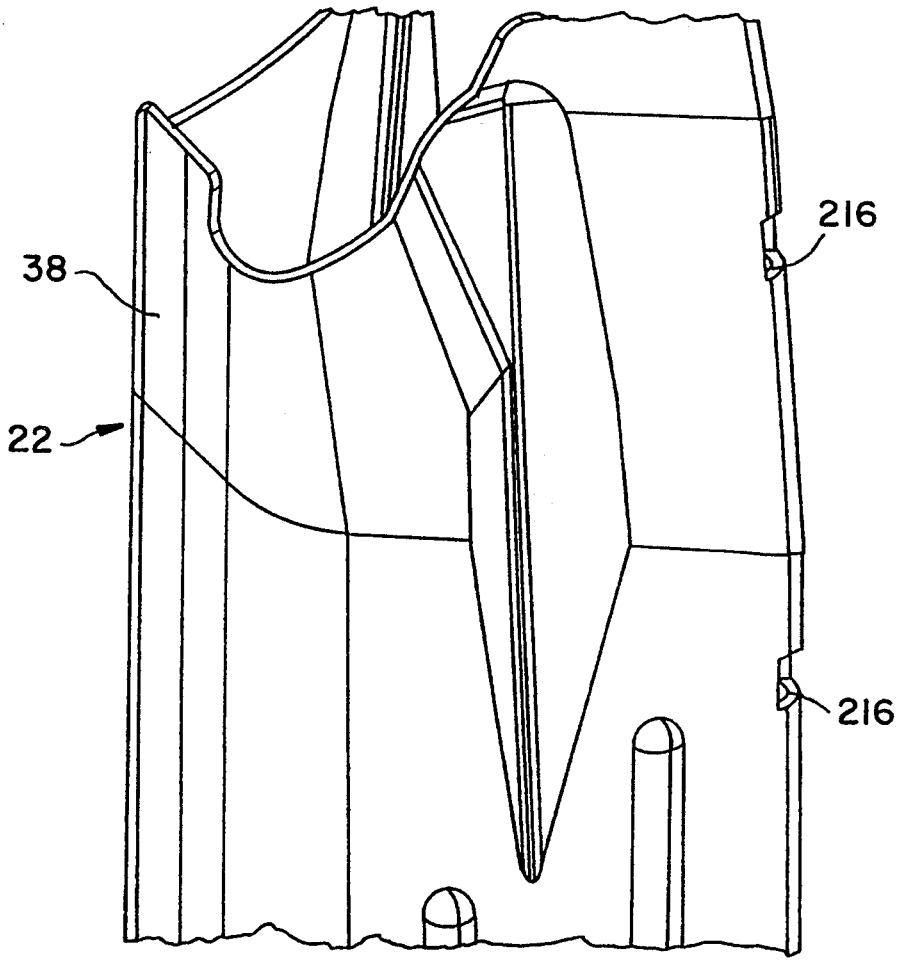
FIG. 5A, 5B is an enlarged, perspective rear view of the nonmetallic member for insertion and connection to the magazine latch assembly.
Figure 5B:
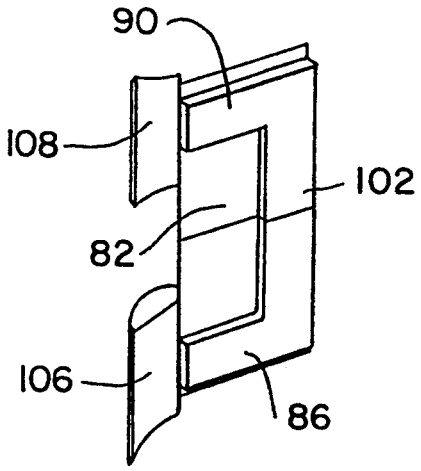

With reference to FIGS. 3–5, as well as FIG. 1, the latch assembly 50 includes a magazine latch retainer 54 and a nonmetallic latch member 58 connected to the magazine latch retainer 54. The magazine latch retainer 54 is made of metal and is integral with the first side wall 26. The magazine latch retainer 54 includes first and second tabs or wing members 62, 66 that are spaced from each other with a center spring tab 70 being defined therebetween. Each of the wing members 62, 66 has a plateau 74, 78, respectively, with each of the plateaus 74, 78 having an edge adjacent to the center spring tab 70. A number of slots 80 are formed adjacent to the center spring tab 70 and the wing members 62, 66. The slots 80 are located at the periphery of the center spring tab 70 and also above the wing members 62, 66, inwardly of the side wall 26 and away from the second end wall 38. The slots 80 are used in engaging the latch member 58.

Figure 16:
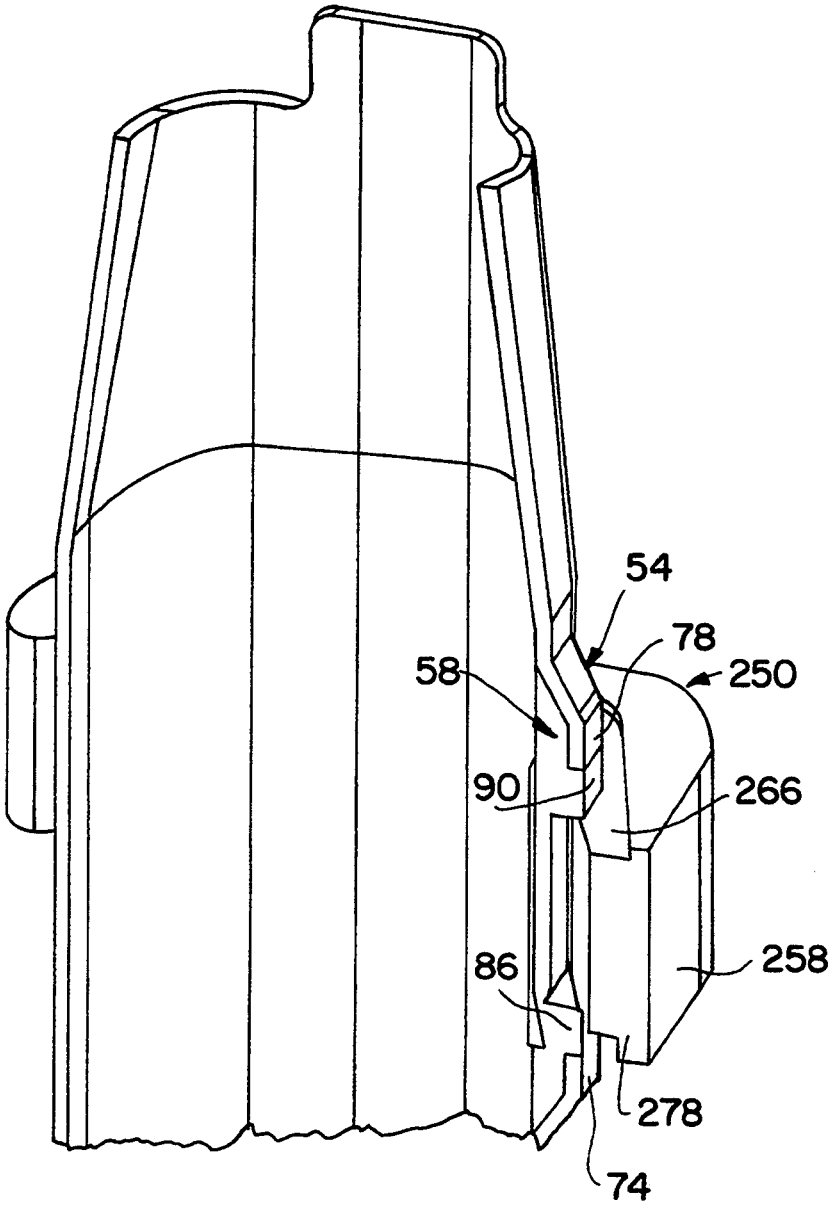
FIG. 16 is an enlarged, fragmentary sectional view illustrating the engagement between the firearm latch of the present invention and the latch assembly of the present invention.

The nonmetallic latch member 58 includes a firearm latch receiving section 82 that is disposed between first and second side walls 86, 90. Adjacent to and integral with the side walls 86, 90 are first and second latch receiving areas 94, 98, respectively. An end wall 102 is joined to edges of these side walls, receiver areas and receiving section. As seen in FIG. 1, when the nonmetallic member 58 is joined to the magazine latch retainer 54, the magazine latch receiving section 82 overlies at least portions of the center spring tab 70. As seen in FIG. 16, the first latch receiver area 94 underlies the plateau 74 and the second latch receiver area 98 underlies the plateau 78. Edges of the first and second side walls 86, 90 and end wall 102 contact and engage edges of the first and second wing members 62, 66. This arrangement, together with the insertion of the first and second latch receiver areas 94, 98 between the wing members 62, 66 and the magazine body portions underneath including use of the slots 80, provide a desired connection between the nonmetallic latch member 58 and the magazine latch retainer 54. As seen in FIGS. 4 and 5, in one embodiment, the nonmetallic latch member 58 has a pair of foot members 106, 108 that are integral with the first and second side walls 86, 90, respectively. The foot members 106, 108 are curved to conform to the rounded edges that define the boundary between the magazine side wall 26 and the magazine end wall 38. In connecting the nonmetallic latch member 58 to the magazine latch retainer 54, the nonmetallic latch member 58 is positioned to be inserted in the direction shown in FIGS. 4 and 5, i.e., the nonmetallic latch member 58 is inserted from the second end wall 38 towards or across the first side wall 26.

The nonmetallic latch member 58 is preferably made of a plastic material and is a one-piece part. When the magazine 10 is located in the firearm well, the firearm latch receiving section 82, together with the side walls 86, 90 and the end wall 102 define a cavity or mating area for receiving portions of the firearm latch. The cooperation between the portions of the firearm latch and these parts of the nonmetallic latch member 58 provide a desired mating connection between the magazine 10 and the firearm, with the center spring tab 70 acting as a locking spring member from below.

Figure 6:
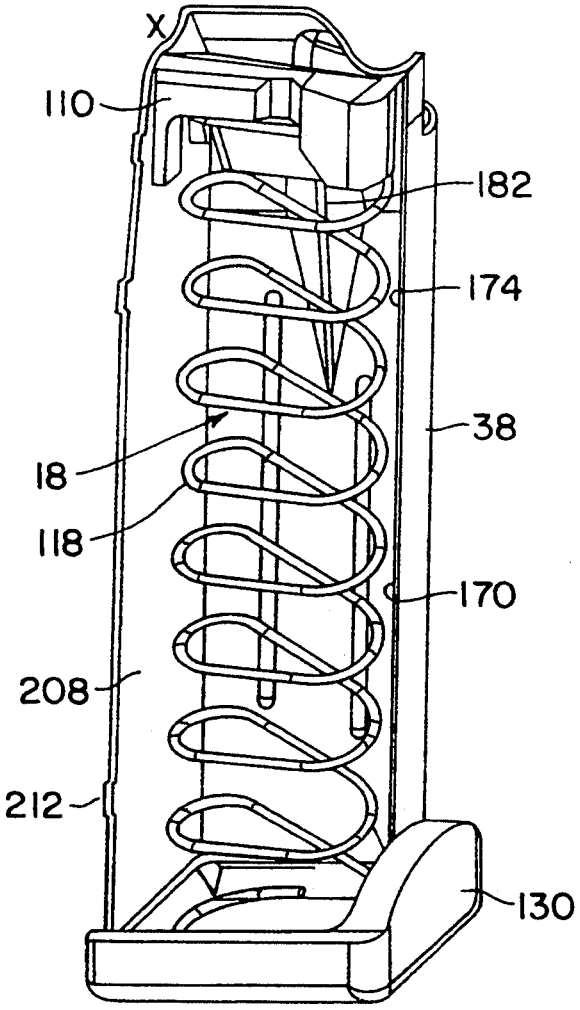
FIG. 6 is a perspective view with the first side wall of the magazine removed to illustrate parts of the magazine, particularly the follower assembly.
Figure 7:
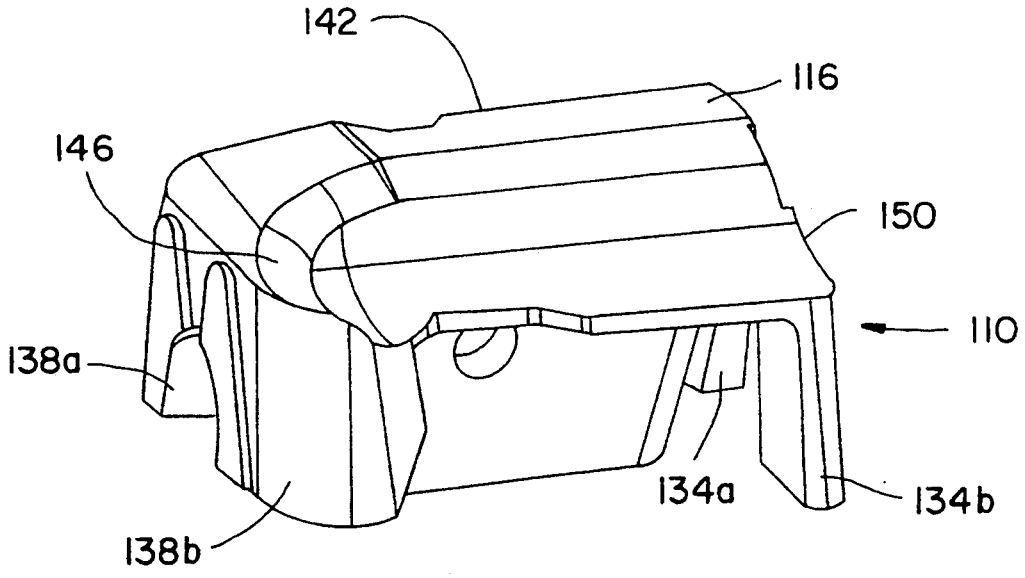
FIG. 7 is a front perspective view of the follower body.
Figure 8:
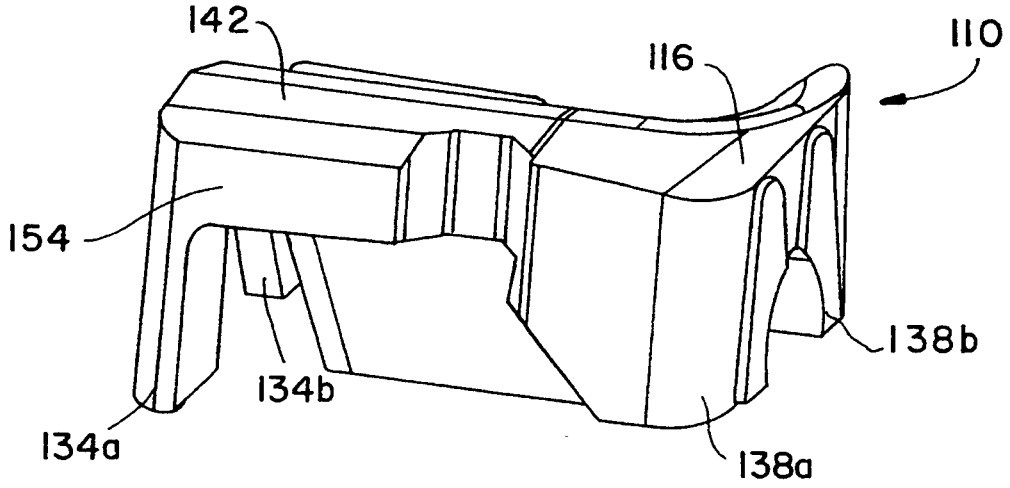
FIG. 8 is a rear perspective view of the follower body.

With reference to FIGS. 6–8, as well as FIG. 3, the follower assembly 14 includes a follower body 110 having a cartridge support surface 116. The follower body 110 is connected to a coil spring 118 that provides the necessary force for moving cartridges relative to the magazine body 22 when successive individual cartridges exit the magazine 10 into the firearm. The end of the coil spring 118 opposite the end connected to the follower body 110 is held by or reacts against a connector plate 122. The connector plate 122 is of a size to be received by a recess 126 formed in a base plate 130. The base plate 130 is tightly held about the bottom end of the magazine body 22, as seen in FIGS. 1 and 2.

Returning to the follower body 110, it also includes pairs of legs **134*a*, 134*b* and 138*a*, 138*b*. The legs 134*a*, 134*b* contact the first end wall 34 of the magazine body 22 during movement of the follower body 110 relative to the magazine body 22. The leg pair 138*a*, 138*b* contact the second end wall 38 during movement of the follower body 110 relative to the magazine body 22. Each of the spaced leg pairs 134*a*,134*b* and 138*a*, 138*b* facilitate movement of the follower body 110 since fine particles, which are created during discharge of the firearm, are pushed aside to avoid the creation of unwanted friction as the follower body 110 moves within the magazine body 22. The follower body 110 also has a crown section 142 that constitutes the highest part of the follower assembly 14 and the top of the crown section 142 being the highest point of the follower assembly 14 when it is located in an upstanding magazine body 22 with the base plate 130 located at the bottom. As seen in FIG. 7, the follower body 110 also has a bolt hold open platform 146 for engagement with a bolt hold open or slide mechanism provided with the firearm. In conjunction with the last cartridge being released from the magazine 10, as is accomplished with prior art magazines, an indication is provided by activation of a bolt hold open or slide mechanism that the magazine 10 is empty of cartridges. When the bolt hold open platform 146 cooperates with the bolt hold open mechanism on the firearm, the firearm slide mechanism is positioned to indicate that there are no more cartridges in the magazine 10**.

With regard to ensuring or enhancing the cooperation between the bolt hold open platform 146 and the bolt hold open mechanism on the firearm, the crown section 142 is disposed on a side of the follower body 110 opposite from the side adjacent to the bolt hold open platform 146. That is, the bolt hold open platform 146 is formed adjacent to a first side 150 of the follower body 110, while the crown section 142 is more adjacent to the opposite or second side 154 of the follower body 110 (also more adjacent to lip 162 of the magazine body 22 when the follower body 110 is positioned within the magazine 10). Such an arrangement is opposite that of crown sections on other follower bodies. In the prior art, such a crown section is commonly found adjacent to the same side of the follower body as the bolt hold open platform. This positioning of the crown section 142 assists or contributes to proper cooperation and engagement between the bolt hold open platform 146 and the bolt hold open or slide mechanism of the firearm. In particular, the magazine body 22, at its outlet end 158 has a first lip 162 and a second lip 166 (see FIG. 3). The lips 162, 166 are formed more adjacent the first end wall 34 than they are the second end wall 38 of the magazine body 22 and are, therefore, more adjacent to the end of the follower body 110 that supports rim ends, as opposed to nose ends, of the cartridges. In connection with the last cartridge being released from the magazine 10 into the firearm, the crown section 142 slidably engages or contacts the first lip 162 which causes the follower body 110 to move or rotate in a direction that better positions the bolt hold open platform 146 for receiving the bolt hold open mechanism on the firearm. That is, such an engagement causes the follower body 110 to move upwardly towards the outlet end 158 and, at the same time, cause the bolt hold open platform 146 to move in a direction to be aligned for activating the bolt hold open mechanism of the firearm. Accordingly, certainty of engagement therebetween is assured after the exit of the last cartridge from the magazine 10.

Figure 9:
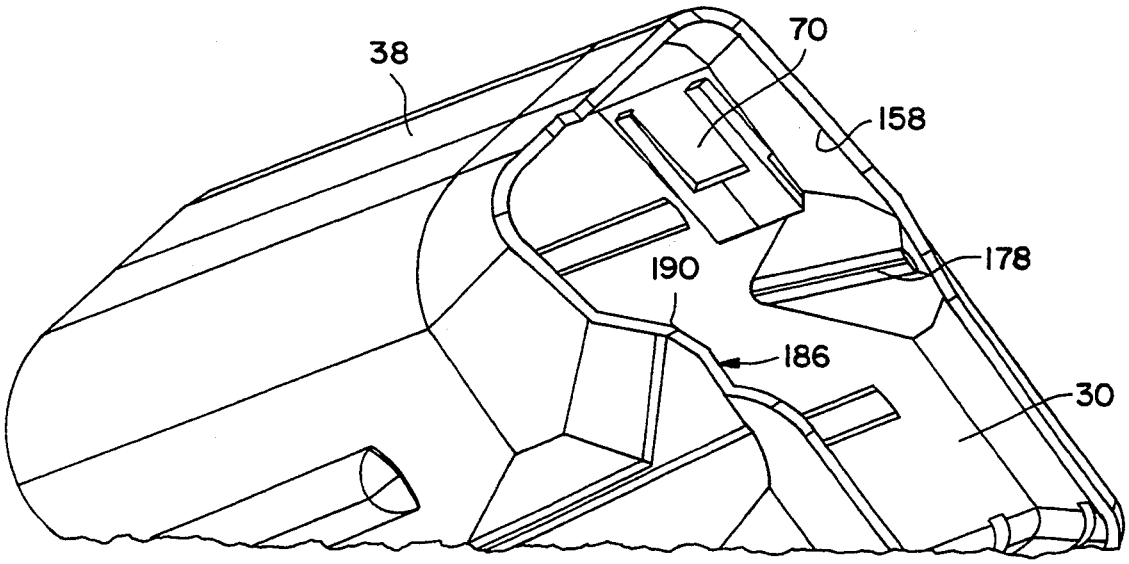
FIG. 9 is a side elevational view of the inner surface of the first side wall illustrating the first interior rib.
Figure 10:
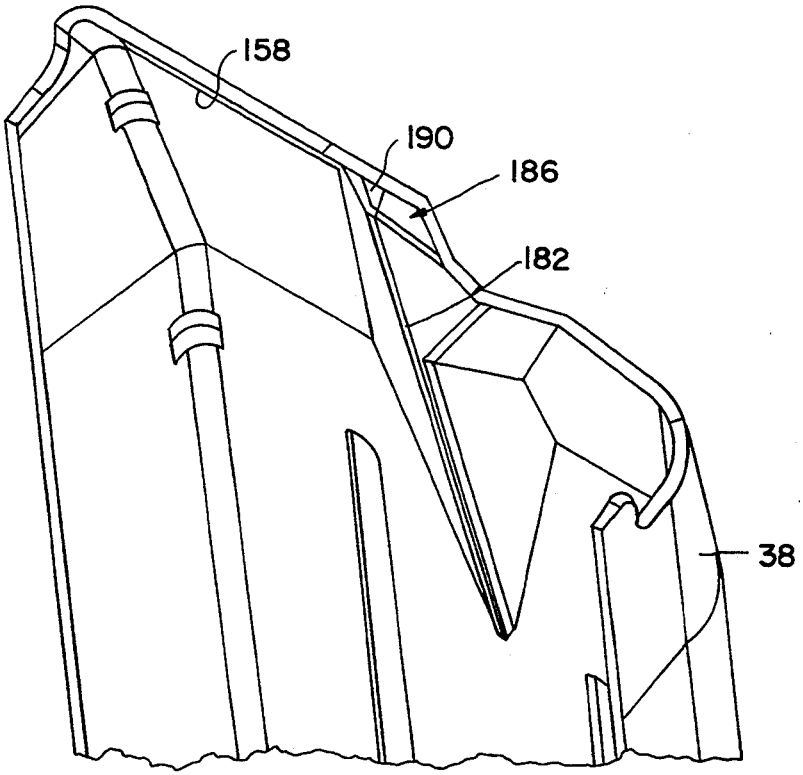
FIG. 10 is a side elevational view of the inner surface of the second side wall illustrating the nonsymmetrical second interior rib.

With respect to activation of the bolt hold open mechanism, it is undesirable to have a bolt hold open condition when cartridges are still remaining in the magazine 10. Such premature activation can be caused by certain structurally configured cartridges, e.g., cartridges having long or unusual bullet head or nose end designs. To overcome a premature bolt hold open condition caused by such a cartridge, non-symmetric ribs are formed on the inner surfaces of the first and second side walls 26, 30, respectively, as seen in FIGS. 9 and 10. The nonsymmetry is relative to a center line through the rib. As is accomplished in the prior art, the magazine body 22 is configured to hold cartridges in a double column arrangement and transition the double column of cartridges to a single column as the cartridges approach the outlet end 158 of the magazine body 22. In that regard, the magazine chamber 18, as indicated in FIG. 6, has a storage zone 170 for containing a double column of cartridges and a transition zone 174 wherein the double column transitions into a single column of cartridges so that individual cartridges alternate from left to right and are released into the firearm. The transition zone 174 is defined using first and second interior ribs, 178, 182 formed on the inner surfaces of the first and second side walls 26, 30, respectively. The use of such ribs to convert or translate a double column of cartridges into a single column over a length of a magazine body is well-known. However, the second rib 182 has upper end portions 186 that are nonsymmetrical relative to corresponding upper end portions of the first rib 178 (see FIG. 10). That is, the upper end portions 186 adjacent to the outlet end 158 diverge in a direction towards the second end wall 38, in comparison with end portions of the first rib 178. The upper end portions 186, in one embodiment, taper about 0.020 inch from the center line of the rib 182. The upper end portions of the second rib also have a substantially flat area 190. The upper end portions 186, including the flat area 190, are utilized to avoid potential premature bolt hold open conditions. As each cartridge moves to be positioned at the outlet end 158 of the magazine 10, the non-symmetric upper end portions 186 and the flat area 190 thereof are able to engage or contact cartridge portions and divert or move the cartridge, if necessary, away from a position that might cause engagement between the cartridge and bolt hold open mechanism on the firearm. Hence, cartridges are movable in a direction away from the firearm bolt hold open mechanism.

Figure 11:
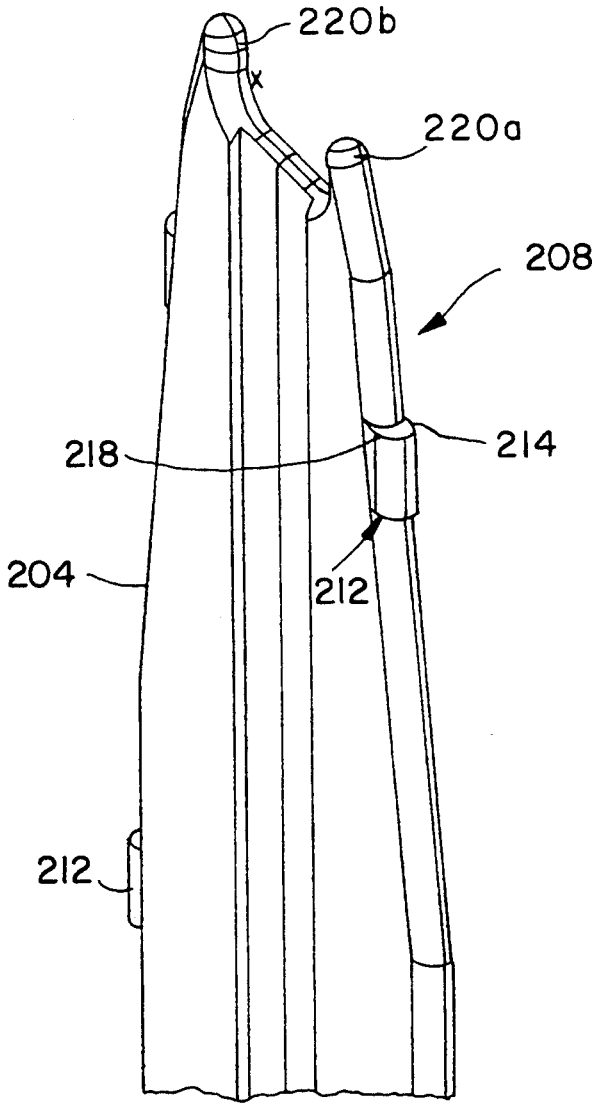
FIG. 11 is an enlarged, fragmentary perspective view of the spacer assembly better illustrating the shape of the tabs thereof.
Figure 12:
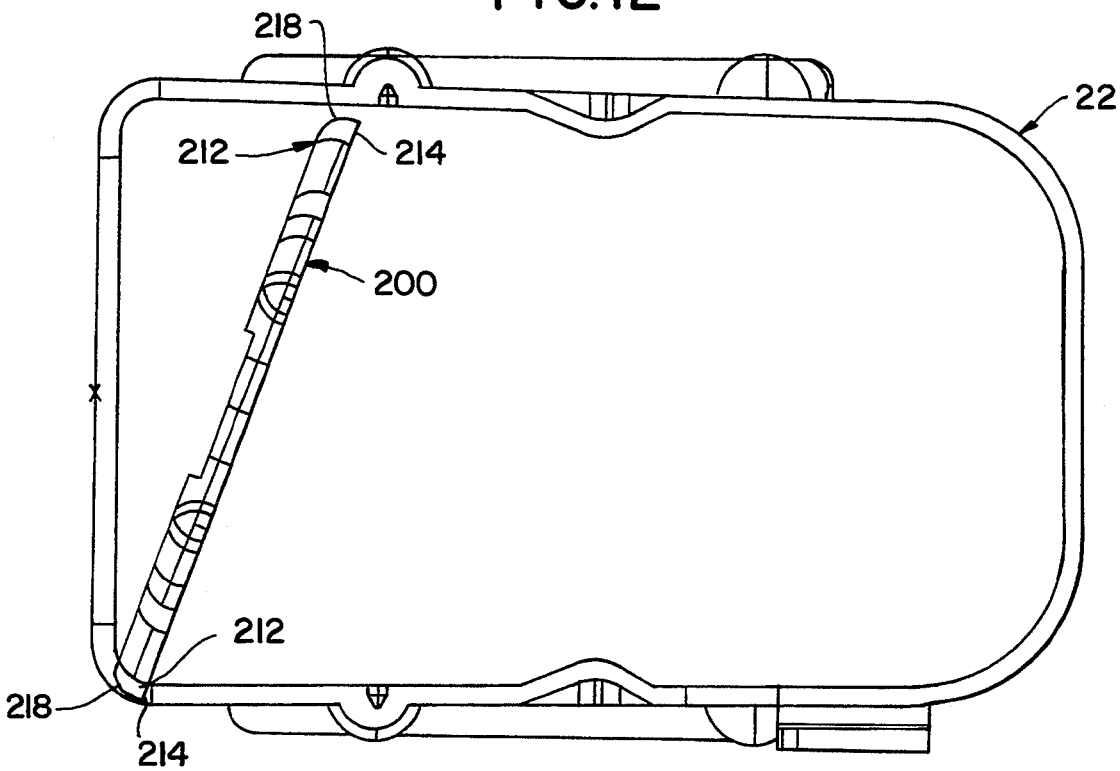
FIG. 12 is an end view illustrating the spacer assembly to be positioned adjacent an end wall of the magazine.
Figure 13:
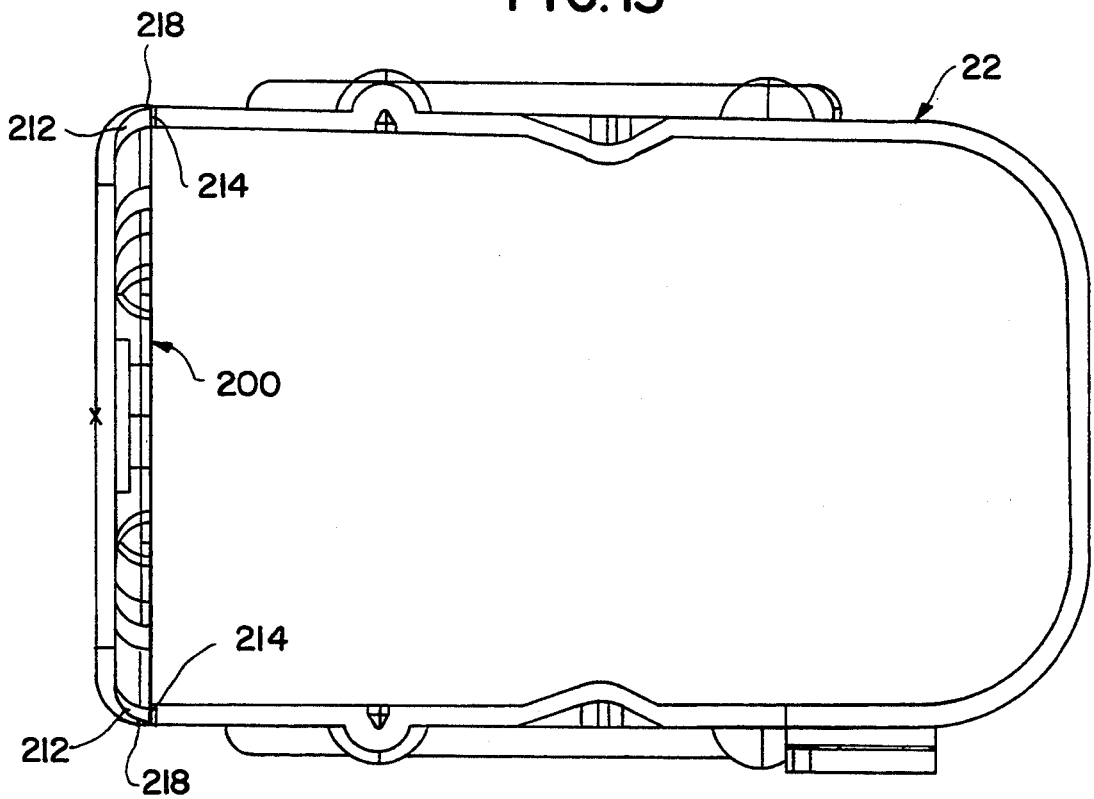
FIG. 13 is an end view illustrating the spacer assembly held adjacent the end wall using the mating engagement between the tabs and end wall holes.

As seen in FIGS. 11–13, as well as FIG. 3, the magazine 10 also includes a spacer assembly 200 that is disposed to overlie an inner surface of the first end wall 34 of the magazine body 22. The spacer assembly 200 is used in taking up space within the magazine chamber 18 to accommodate proper storage and movement of the particular sized cartridges used with the magazine 10, without having to resort to ribs on the end wall 34. This keeps the rims from engaging a "hole" or other discontinuity in the wall and jamming therein. In the absence of the spacer assembly 200, the magazine chamber 18 would be of too great a size to permit proper movement of the cartridges. The spacer assembly 200 includes a spacer body 204 having, in one embodiment, a smooth outer surface 208, although it could be formed with ribs to allow fine particles a place to settle that would not interfere with magazine operation. The outer surface 208 is away from the inner surface of the first end wall 34 and the rim ends of the cartridges contact this outer surface 208 during their movement relative to the magazine body 22. The smooth outer surface 208 acts to facilitate movement of the cartridges and reduces friction that is present during cartridge movement. The spacer assembly 200 is preferably made of a polymer material and, in one embodiment, is connected to the first end wall 34 using a plurality of tabs 212 that project from edges of the spacer body 204 along its length. The magazine body 22 includes a number of holes 216 formed therein adjacent to the first end wall 34. The holes 216 receive the tabs 212 to fixedly hold the spacer assembly 200 adjacent to the first end wall 34. The tabs 212 have a special shape in which they snap readily into the holes 216 but cannot be removed once positioned in the holes 216 by rotation of the spacer assembly 200. In that regard, each tab 212 includes a straight section 214 and a rounded or curved section 218. When connecting the spacer assembly 200 to the first end wall 34, as seen in FIG. 12, the tabs 212 on a first side of the spacer assembly 200 are inserted in the holes 216 formed on a first side of the end wall 34. Then, the tabs 212 on the second side are moved, with the first side of the spacer assembly 200 acting as a pivot area, into the holes 216 on the second side of the end wall 34. The curved sections 218 of the tabs 212 are the leading portions so that the inner surface of the magazine side wall does not act as a barrier to the insertion of the tabs 212 into the holes 216. After connection, as seen in FIG. 13, the straight sections 214 of the tabs 212 act to prevent escape of the tabs 212 from the holes 216 since these straight sections 214 are abutting the straight edge portions of the end wall 34 that define the holes 216. The spacer assembly 200 also has a pair of ears **220*a*, 220*b* extending from the upper part of the spacer body 204. The ears 220*a*, 220*b* are located at the upper part of the first end wall 34 adjacent to the outlet end 158 when the spacer assembly 200 is connected to the magazine body 22**.

As can be appreciated, other configured spacer assemblies could be employed. Instead of providing exterior ribs 42, 44, a relatively uniform exterior surface could be used. In such a case, the spacer assembly would also include sections or pieces that overlie the first and second side walls 26, 30. Such a spacer assembly would have a U-shape (top view) and the necessary fitting arrangement among the firearm well, magazine and cartridges would be accommodated using the spacing provided by this U-shaped boot or spacer assembly.

Figure 14:
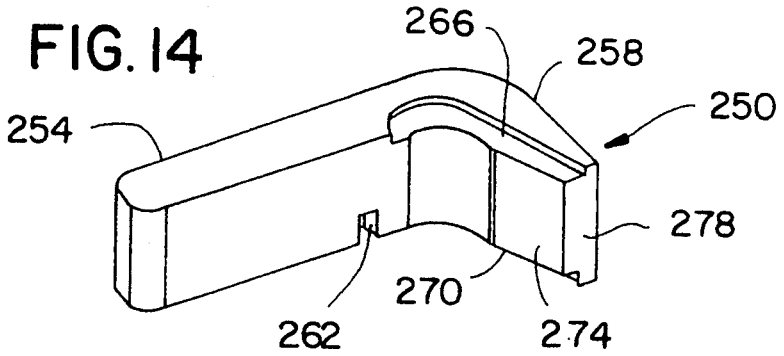
FIG. 14 is a front perspective view of the firearm latch of the present invention.
Figure 15:
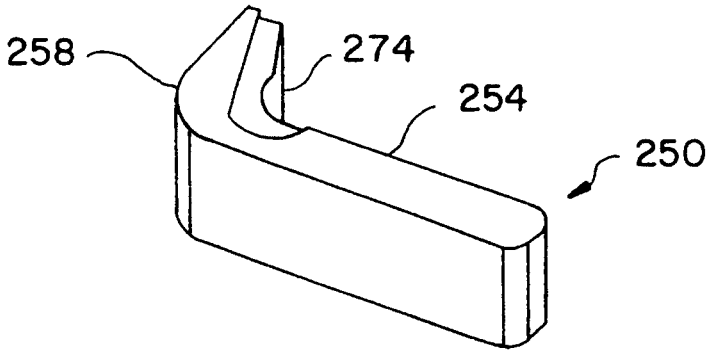
FIG. 15 is a rear perspective view of the firearm latch of FIG. 14.

In another embodiment, a different firearm latch can be substituted for the plastic firearm latch utilized in the prior art, such as the plastic latch found in the Glock pistol. With reference to FIGS. 14 and 15, a firearm latch 250 is illustrated and includes a first or longer leg 254 and a second or shorter leg 258. The legs 254, 258 are integrally formed to provide the one-piece firearm latch 250. The first leg 254 has a cutout 262 formed in an edge portion thereof. The cutout 262 is used for receiving a wire spring in order to hold the firearm latch 250 to the grip or handle of the firearm. The second leg 258 is used for engagement with or interconnection to a latch assembly on a magazine positioned in the firearm well and includes first and second edge engagement surfaces 266, 270. As seen in FIG. 16, each of the two engagement surfaces 266, 270 engages or contacts first and second side walls 86, 90, respectively, of the nonmetallic member 58. A key aspect in differentiating known prior art including the firearm latch found in the Glock pistol relates to the geometry of the firearm latch 250 and, in particular, to the structure of the shorter leg 258. The shorter leg 258 is configured such that a larger engagement area or "footprint" is achieved when the firearm latch 250 engages the latch assembly 50. A greater area of contact or engagement results in a stronger or more solid interconnection between the firearm latch 250 and the latch assembly 50. In that regard, the shorter leg 258 includes a free end 278 and a length or depth defined along the longitudinal extent of the shorter leg 258 towards the longer leg 254. The shorter leg 258 also has a lateral extent in a direction normal to the longitudinal extent. The product of the lateral and longitudinal dimensions provides the engagement area, with the greater engagement area being achieved by having contact, at a greater or longer depth of the shorter leg 258, with the latch assembly 50. As seen in FIG. 16, the firearm latch 250 is inserted between the walls 86, 90 of the nonmetallic member 58. Engagement or contact is provided from the free end 278 of the shorter leg 258 along the lengths or depths of the two edge engagement surfaces 266, 270 of the shorter leg 258. Additionally, the bottom face 274 is configured or shaped to contact the firearm latch receiving section 82. Hence, the first and second edge engagement surfaces 266, 270, together with the bottom face 274, provide the desired interconnection between the firearm latch 250 and the latch assembly 50, when the magazine 10 is positioned in the firearm well.

Figure 17:
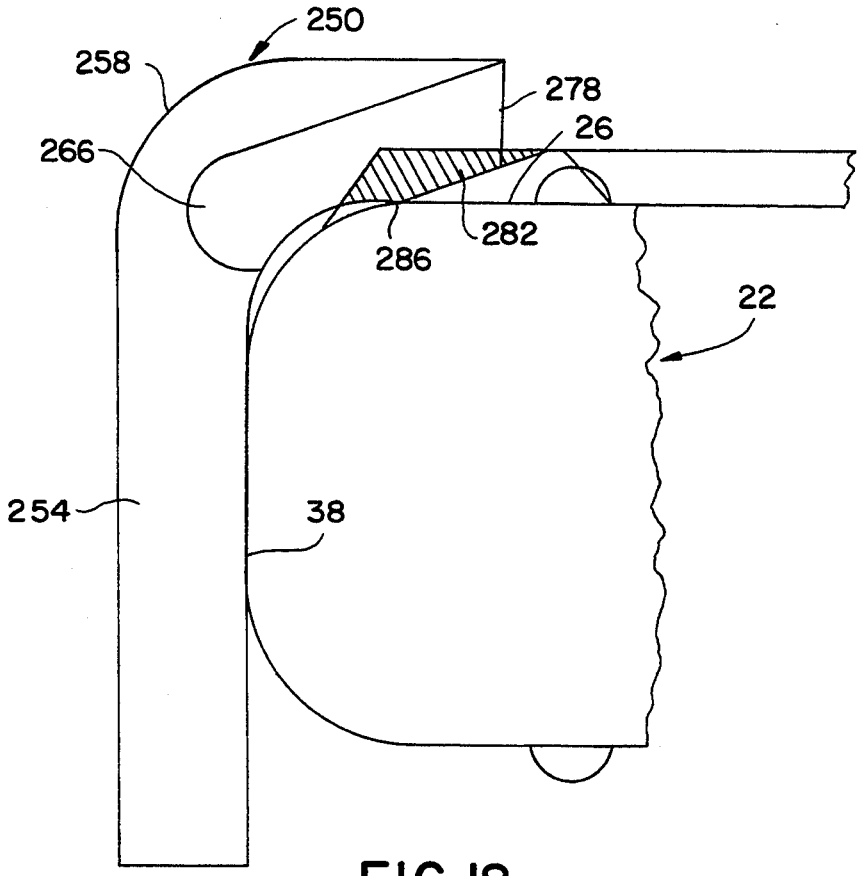
FIG. 17 is an enlarged, fragmentary, end elevational view illustrating engagement between the firearm latch of FIG. 14 and the latch assembly of the magazine of the present invention.
Figure 18:
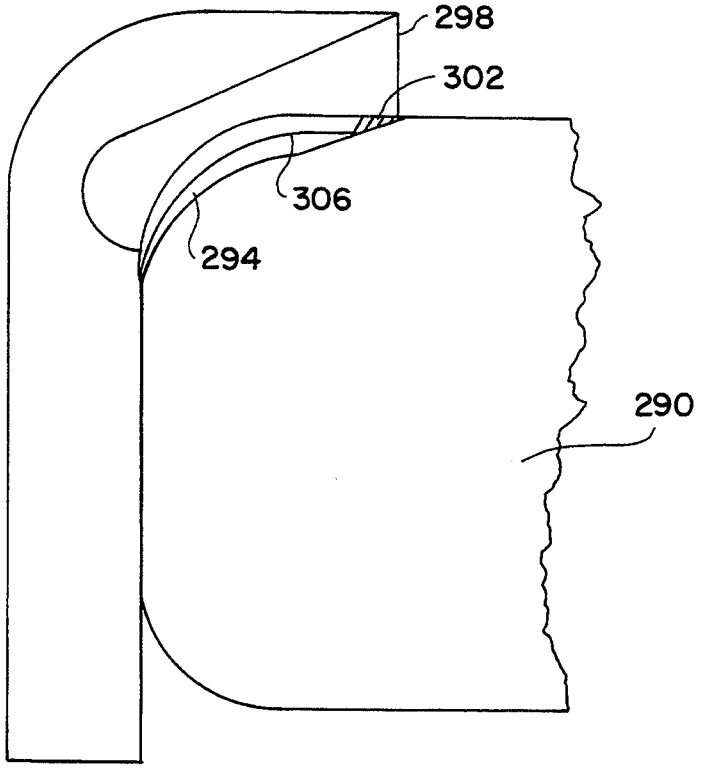
FIG. 18 PRIOR ART
FIG. 18 is an enlarged, fragmentary, end elevational view illustrating engagement between the prior art firearm latch and prior art magazine of Glock.

Reference is now made to FIGS. 17 and 18 in order to compare the present invention with the known prior art. In FIG. 17, a schematic representation is provided that illustrates the greater engagement area or footprint achieved by the firearm latch 250, when it engages the magazine body 22 of the present invention using the latch assembly 50. In this illustration, an engagement area or footprint 282 is depicted using diagonal lines, with this footprint representing the area of connection or contact between the magazine 10 and the firearm latch 250. As can be seen, the engagement area extends from the free end 278 of the shorter leg 258 at least to a point, relative to the magazine body 22, where the magazine side wall 26 begins to be joined to the end wall 38 by a rounded or curved corner. That is, the engagement area extends at least to the beginning of the radius of curvature that joins together the side wall 26 and the end wall 38. The beginning of the radius of curvature is denoted by the reference number 286.

Referring to FIG. 18, the engagement between the prior art firearm latch and prior art magazine of Glock is illustrated. The magazine 290 includes a cutout area 294 for engagement with this prior art firearm latch 298. The firearm latch 298 is illustrated in its engagement position with the magazine 290 after it is positioned in the firearm well (not shown). A relatively small engagement area 302 is illustrated using diagonal lines drawn in the engagement area 302 of the cutout 294. Also illustrated is a point 306 that indicates the beginning of the radius of curvature in connection with the magazine 290. As is seen, the engagement area 302 does not extend to the beginning of the radius of curvature. Such an engagement area or footprint is substantially different from that illustrated in FIG. 17. In one embodiment, the length or depth of the engagement area 286 associated with the footprint illustrated in FIG. 17 is about 0.070 inch, i.e., this is the distance from the free end 278 into the depth or along the length of the bottom face 274 and along which depth there is contact or engagement. Such a depth is about two times that of the depth of the prior art combination illustrated in FIG. 18.

Figure 19:
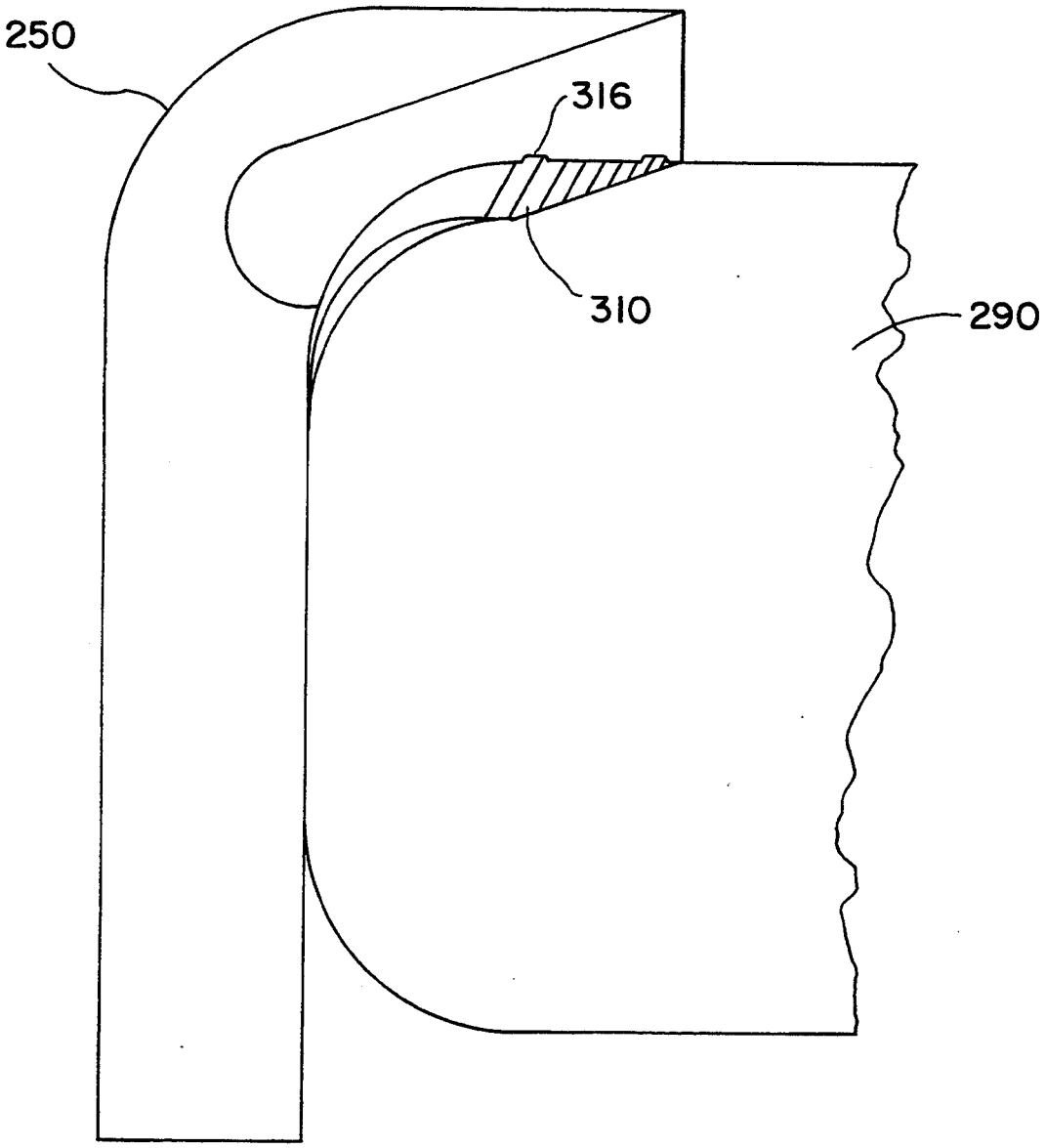
FIG. 19 is an enlarged, fragmentary, end elevational view illustrating engagement between the prior art magazine of Glock and the latch assembly of the present invention.
Figure 20:
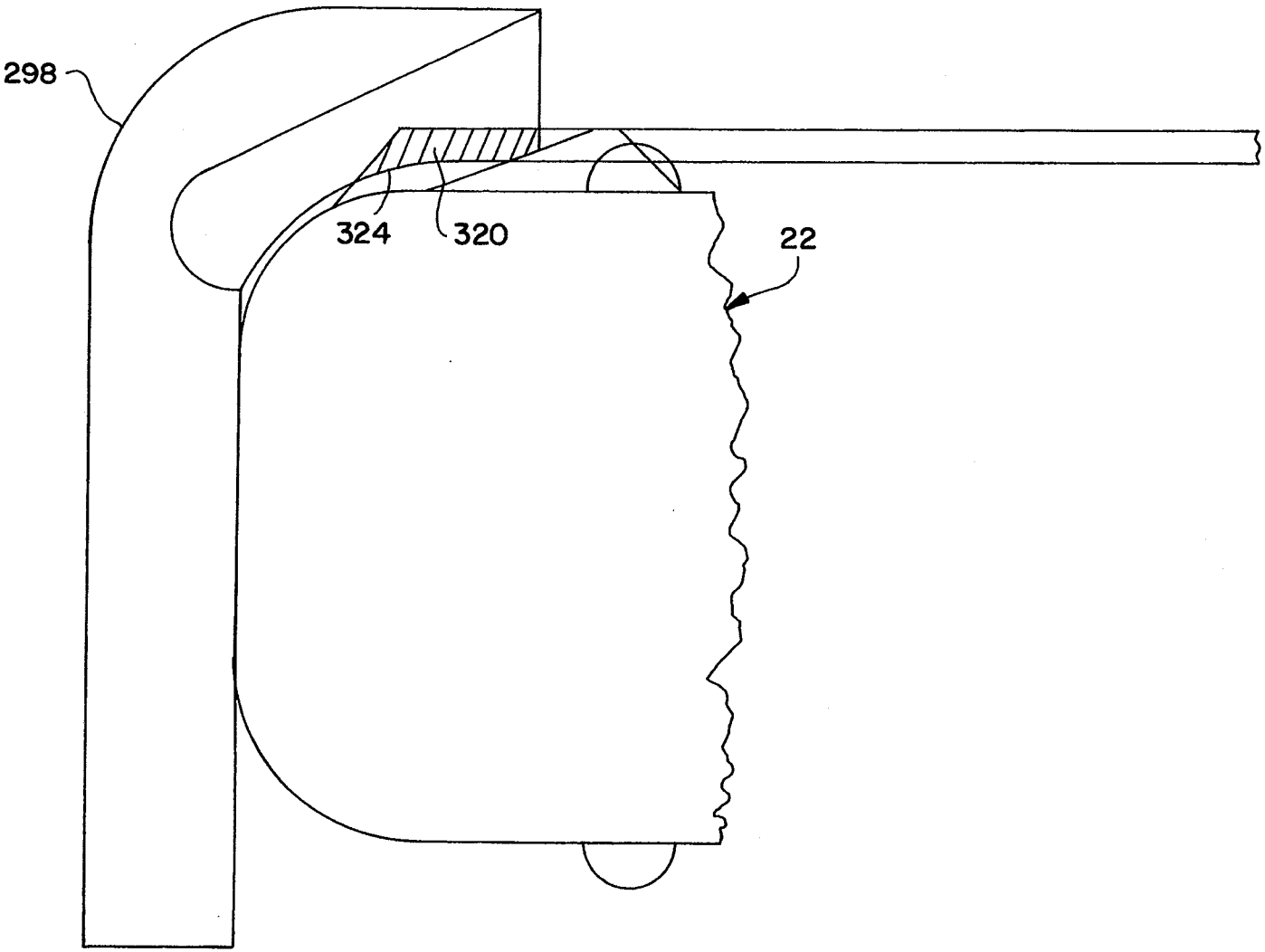
FIG. 20 is an enlarged, fragmentary, end elevational view illustrating engagement between the prior art firearm latch of Glock and the latch assembly of the present invention.

Referring now to FIGS. 19 and 20, the firearm latch 250 and the magazine 10 of the present invention also provide a larger footprint when used with the prior art magazine of Glock and the prior art firearm latch of Glock, respectively. In FIG. 19, the firearm latch 250 engages the prior art magazine 290. As with FIGS. 17 and 18, an engagement area or footprint 310 results or is defined and is illustrated by the diagonal lines that extend from the free end 278 into the depth of the shorter leg 258. The beginning of the radius of curvature is represented at 316 and the engagement area 310 includes this part of the prior art magazine 290. Hence, greater engagement is provided between the magazine latch 250 and the prior art magazine 290, in comparison with using the prior art firearm latch 298. Similarly, as seen in FIG. 20, when the magazine 10 is held by the prior art latch 298, a greater engagement area 320 results, in comparison with the prior art illustration of FIG. 18. In FIG. 20, the engagement area 320 is also illustrated by the diagonal lines drawn between the firearm latch 298 and the magazine 10. The radius of curvature begins at about reference number 324. The engagement area 320 also includes the beginning of the radius of curvature 324.

The firearm latch 250 is preferably made using a carbon fiber filled material. This material results in a substantially more durable and harder piece for engagement with the latch assembly 50. As a consequence, firearm latch wear is reduced over that which occurs when a plastic firearm latch is utilized. The carbon fiber filled firearm latch has characteristics associated with a metal latch, but is not metal and is injection moldable.

In view of the foregoing detailed description of the various aspects of the present invention, a number of worthwhile features are immediately recognized. A firearm magazine is provided which has a metal body, but a nonmetallic latch mechanism. When used with a plastic firearm latch, the nonmetallic latch mechanism substantially reduces wear on the portion of the firearm latch that engages the nonmetallic latch mechanism. The nonmetallic latch mechanism is separately made from the metallic magazine body, but is easily connected thereto and fixedly held for proper engagement-/disengagement with the firearm latch for the life of the magazine. A spacer assembly is provided for accommodating proper storage and movement of the cartridges relative to the magazine body, including the use of a very smooth surface along which rim ends of cartridges are able to readily move. Mechanisms are also provided for proper operation of the bolt hold open mechanism on the firearm. First, a crown section is advantageously located on a follower body to cause proper positioning of a bolt hold open platform so that the bolt hold open platform and the bolt hold open mechanism on the firearm cooperate on release of the last cartridge from the magazine. Secondly, a non-symmetrical interior rib portion is formed to ensure that no cartridge improperly engages the bolt hold open mechanism. Lastly, instead of a plastic or metal firearm latch for engagement with a magazine latch, a carbon fiber filled latch is provided, which results in reduced wear thereof in comparison with an all plastic latch. This firearm latch has a greater engagement area to provide a stronger interconnection between the firearm latch and the magazine.

The foregoing description of the inventions has been presented for purposes of illustration and description. Further, the descriptions are not intended to limit the inventions to the form disclosed therein. Consequently, variations and modifications commensurate with the above teachings, and the skill or knowledge and the relevant art are within the scope of the present inventions. The embodiments described hereinabove are further intended to explain the best mode known of practicing the inventions and to enable others skilled in the art to utilize the inventions in various embodiments and with the various modifications required by their particular applications or uses of the invention. It is intended that the appended claims be construed to include alternative embodiments to the extend permitted by the prior art.

What is claimed is:

1. A magazine for use with a firearm that includes a firearm latch positioned in a well of the firearm, comprising:

a magazine body having first and second side walls and first and second end walls and being made of a first material comprising metal and including retainer means disposed on an outer surface of one of said walls;

a follower assembly disposed within said magazine body for use in moving cartridges relative to said magazine body; and a latch member separate from said magazine body but connected to said retainer means and overlying at least portions of said retainer means, said latch member being made of a second material different from said metal of said first material, said magazine body and said latch member, when connected together, defining a combination with the majority of said combination being made from said metal first material and wherein, when said magazine body is held in the firearm, a portion of the firearm latch engages said latch member for holding said magazine body in the firearm well.

2. A magazine, as claimed in claim 1, wherein said latch member includes:

a first wall;

a second wall spaced from said first wall; and a firearm latch receiving section positioned between said first and second walls.

3. A magazine, as claimed in claim 1, wherein:

said latch member has plastic material.

4. A magazine, a claimed in claim 3, wherein:

said retainer means includes first and second spaced wing members engaging portions of said latch member.

5. A magazine, as claimed in claim 1, further including:

a spacer assembly positioned within said magazine body.

6. A magazine, as claimed in claim 1, wherein:

said spacer assembly includes a spacer body overlying an inner surface of said first end wall.

7. A magazine, as claimed in claim 5, wherein:

said spacer assembly includes a spacer body having a smooth plastic surface.

8. A magazine, as claimed in claim 1, wherein: said magazine body includes first and second end walls and first and second side walls, said first side wall having a first rib protruding from an inner surface thereof and extending along a length thereof adjacent to an outlet end of said magazine body, with said retainer means also disposed on said first side wall, a second rib protruding from an inner surface of said second side wall and extending along a length thereof adjacent to said outlet end of said magazine body, with end portions of said second rib adjacent to said outlet end being different from end portions adjacent said outlet end of said first rib.

9. A magazine for use with a firearm that includes a firearm latch positioned in a well of the firearm, comprising:

a magazine body having a metal material and including retainer means, said retainer means including first connection means that includes a first wing member having an edge;

a follower assembly disposed within said magazine body for use in moving cartridges relative to said magazine body; and a latch member connected to said retainer means, said latch member including a first magazine latch receiver means that includes a first magazine latch receiver area and a first side wall and in which said edge engages said first side wall and overlies said first magazine latch receiver area wherein, when said magazine body is held in the firearm, a portion of the firearm latch engages said latch member for holding said magazine body in the firearm well.

10. A magazine for use with a firearm that includes a firearm latch positioned in a well of the firearm, comprising:

a magazine body havinq a metal material and including retainer means, said retainer means including first and second wing members;

a follower assembly disposed within said magazine body for use in moving cartridges relative to said magazine body; and a latch member connected to said retainer means, said latch member includes first and second side walls that fixedly engage said first and second wing members wherein, when said magazine body is held in the firearm, a portion of the firearm latch engages said latch member for holding said magazine body in the firearm well.

11. A magazine for use with a firearm that includes a firearm latch positioned in a well of the firearm, comprising:

a magazine body having metal material and including retainer means said retainer means including a center tab;

a follower assembly disposed within said magazine body for use in moving cartridges relative to said magazine body; and a latch member connected to said retainer means, said latch member including a firearm latch receiving section and in which said firearm latch receiving section overlies said center tab wherein, when said magazine body is held in the firearm, a portion of the firearm latch engages said latch member for holding said magazine body in the firearm well.

12. A magazine for use with a firearm that includes a firearm latch positioned in a well of the firearm, comprising:

a magazine body having metal material and including retainer means, said retainer means including:

a center tab;

a first wing member;

a first slot located adjacent portions of said first wing member and said center tab;

a second wing member; and a second slot located adjacent portions of said second wing member and said center tab;

a follower assembly disposed within said magazine body for use in moving cartridges relative to said magazine body.; and a latch member connected to said retainer means, said latch member including a first wall, a second wall spaced from said first wall and a firearm latch receiving section positioned between said first and second walls wherein said first wall overlies said first slot and said second wall overlies said second slot and said firearm latch receiving section overlies said center tab and in which, when said magazine body is held in the firearm, a portion of the firearm latch engages said latch member for holding said magazine body in the firearm well.

13. A magazine for use with a firearm, comprising:

a spacer assembly;

a magazine body having metal material and including retainer means, said magazine body including first and second end walls and first and second side walls and said spacer assembly comprising a spacer body overlying an inner surface of said first end wall, said magazine body including a number of holes adjacent to said first end wall and said spacer assembly including a number of tabs connected to said spacer body wherein each of said holes receives one of said tabs for use in holding said spacer assembly to said magazine body; and a follower assembly disposed within said magazine body for use in moving cartridges relative to said magazine body.

14. A magazine for use with a firearm, comprising:

a spacer assembly including a spacer body having a first tab with said first tab having a straight section and a curved section;

a magazine body being made of metal material and having a hole, wherein said curved section is inserted into said magazine hole before said straight section in order to connect said spacer assembly to said magazine body; and a follower assembly disposed within said magazine body for use in moving cartridges relative to said magazine body.

15. A magazine for use with a firearm, comprising:

a magazine body having metal material, said magazine body including first and second end walls and first and second side walls, said first side wall having a first rib protruding from an inner surface thereof and extending along a length thereof adjacent to an outlet end of said magazine body, a second rib protruding from an inner surface of said second side wall and extending along a length thereof adjacent to said outlet end of said magazine body, with end portions of said second rib adjacent to said outlet end being different from end portions adjacent said outlet end of said first rib, said end portions of said second rib extending non-symmetrically relative to said end portions of said first rib toward said second end wall of said magazine body and in a first direction; and a follower assembly disposed within said magazine body for use in moving cartridges relative to said magazine body.

16. A magazine, as claimed in claim 15, wherein:

said end portions of said second rib have a substantially flat area.

17. A magazine for use with a firearm, comprising:

a magazine body having an outlet end and at least a first lip adjacent to said outlet end;

a follower assembly disposed within said magazine body for use in moving cartridges relative to said magazine body, said follower assembly including:

a follower body;

a bolt hold open platform; and a crown section integrally joined to said follower body, with said crown section extending a closer distance towards said outlet end of said magazine body when said follower assembly is located in said magazine than other portions of said follower assembly, said crown section being located more adjacent to a second side of said follower body than a first side thereof and said bolt hold open platform being located closer to said first side than said second side of said follower body, said crown section including portions disposed in contactable alignment with said first lip and being movable relative to said first lip wherein said portions of said crown section contact said first lip during said relative movement and, when said crown section portions contact said first lip, said bolt hold open platform is caused to move in a predetermined direction,

* * * * *